United States Patent [19]

Flower et al.

[11] 4,098,330

[45] Jul. 4, 1978

[54] ANNULAR METAL RECUPERATOR

[75] Inventors: Robert J. Flower; Marshall E. Seddon, both of Lockport, N.Y.

[73] Assignee: General Motors Corporation, Detroit, Mich.

[21] Appl. No.: 708,051

[22] Filed: Jul. 23, 1976

[51] Int. Cl.[2] ..... F28F 3/04

[52] U.S. Cl. ..... 165/166; 60/39.36

[58] Field of Search ..... 60/39–51 R, 60/39.36; 165/145, 157, 166

[56] References Cited

U.S. PATENT DOCUMENTS

| | | | |
|---|---|---|---|
| 3,216,495 | 11/1965 | Johnson | 165/166 |
| 3,228,464 | 1/1966 | Stein et al. | 165/166 |
| 3,255,818 | 6/1966 | Beam, Jr. et al. | 165/166 |
| 3,507,115 | 4/1970 | Wisoka | 60/39.51 |
| 3,818,984 | 6/1974 | Makamura | 165/166 |

*Primary Examiner*—Charles J. Myhre
*Assistant Examiner*—Theophil W. Streule
*Attorney, Agent, or Firm*—K. H. MacLean, Jr.

[57] ABSTRACT

A recuperative heat exchanger for gas turbine engines having an annular configuration with the air and exhaust gases, respectively, passing through the axial faces of the recuperator in counterflow relationship. The recuperator is formed by stacking a plurality of individual plates one against another about a circular form which corresponds to the inner diameter of the annular recuperator. The primary or main body of the plates are involutely curved in the radial direction and an edge extends laterally from this surface. A shoulder formed in the edge engages a portion of the next adjacent plate to space the plates one from another a given predetermined distance. The axially facing edge portions of every other plate is recessed or cut back at a radially inner location to form and inlet an outlet opening for air. Likewise, alternate plates have edge portions which are recessed near a radially outward location to form inlet and outlet openings for exhaust gases.

4 Claims, 24 Drawing Figures

ANNULAR METAL RECUPERATOR

Prior recuperative heat exchangers, particularly for gas turbines, have utilized annularly configured heat exchangers with plane or involutely curved plates to form passages therebetween. Absent in the prior heat exchangers is the formation of edge portions. The prior heat exchangers use center material in a serpentine configuration to maintain spacing. Also, the inlets and outlets for air and exhaust gases have been formed in different faces of the annular configuration, such as passing exhaust gases through one axial face and discharging the exhaust gases out of another axial face, while introducing and discharging air from and to the annular heat exchanger through annular openings in a cylindrical or radial surface of the heat exchanger.

The aforedescribed typical recuperative heat exchanger does not provide as compact or as easily fabricated a heat exchanger as the subjected invention. The use of serpentine-configured fin or center material to solely separate passage-forming plates has several disadvantages. The plates without edge portions, as in the present invention, are flexible and difficult to handle during assembly. Flexible plates do not lie flat nor may the spacing between plates be regulated to any degree of accuracy. Prior recuperative heat exchangers routed air or exhaust through openings in the radial or cylindrical surfaces of the heat exchanger. Since a gas turbine engine housing normally lends itself to forming annular plenum chambers therein, it is desirable to route air and exhaust gases axially through a heat exchanger. The most compact arrangement, as in the present invention, lies in routing both air and exhaust passages from annularly shaped plenum chambers through the axial surfaces or faces of the annular configurated heat exchanger.

The formation of inlets and outlets for air and exhaust gases in the axial faces of the subject heat exchanger forms a compact heat exchanger of high efficiency. By providing radially spaced inlet and outlet openings in the axial faces of the heat exchanger, the air and exhaust gas plenum chambers may be basically concentric in relation and separation between the flow of air and exhaust gases into the heat exchanger may be conveniently provided by relatively simple resilient face seals which engage portions of the axial faces of the heat exchanger.

From the previous discussion, it is apparent that an object of the invention is to provide a compact and highly efficient recuperative heat exchanger for gas turbines of an annular configuration in which the inlets and outlets for air and exhaust gases are formed in the axial faces of the heat exchanger to permit separate entry of air and exhaust gases through these axial faces.

A still further object of the present invention is to provide a recuperative heat exchanger for a gas turbine engine having an annular configuration formed by alternately stacking air and exhaust gas separator plates about a form corresponding to the desired inner diameter of the heat exchanger, the air and exhaust separator plates having a main body portion involutely curved in a radial direction and with a surrounding peripheral edge portion extending normal to the main body portion of the plate with a shoulder formed thereon to engage a like portion of the next adjacent plate, thereby spacing said plate a predetermined distance to form constant height fluid passages therebetween.

A still further object of the present invention is to provide a recuperative heat exchanger for gas turbine engines having an annular configuration formed of alternately stacked air and exhaust gas separator plates, each having a peripheral edge portion which engages the next adjacent separator plate to space the plate and with the axially facing edge portions of the air and exhaust gas plates being cut back to form inlet and outlet openings for air and exhaust gases which are radially spaced on the axial faces to permit the introduction of air and exhaust gases from concentric annular plenum chambers of the turbine.

Still further objects and advantages of the present invention wil be more readily apparent from the following detailed description, reference being had to the accompanying drawings in which preferred embodiments of the heat exchanger are illustrated.

IN THE DRAWINGS

Figure 1:
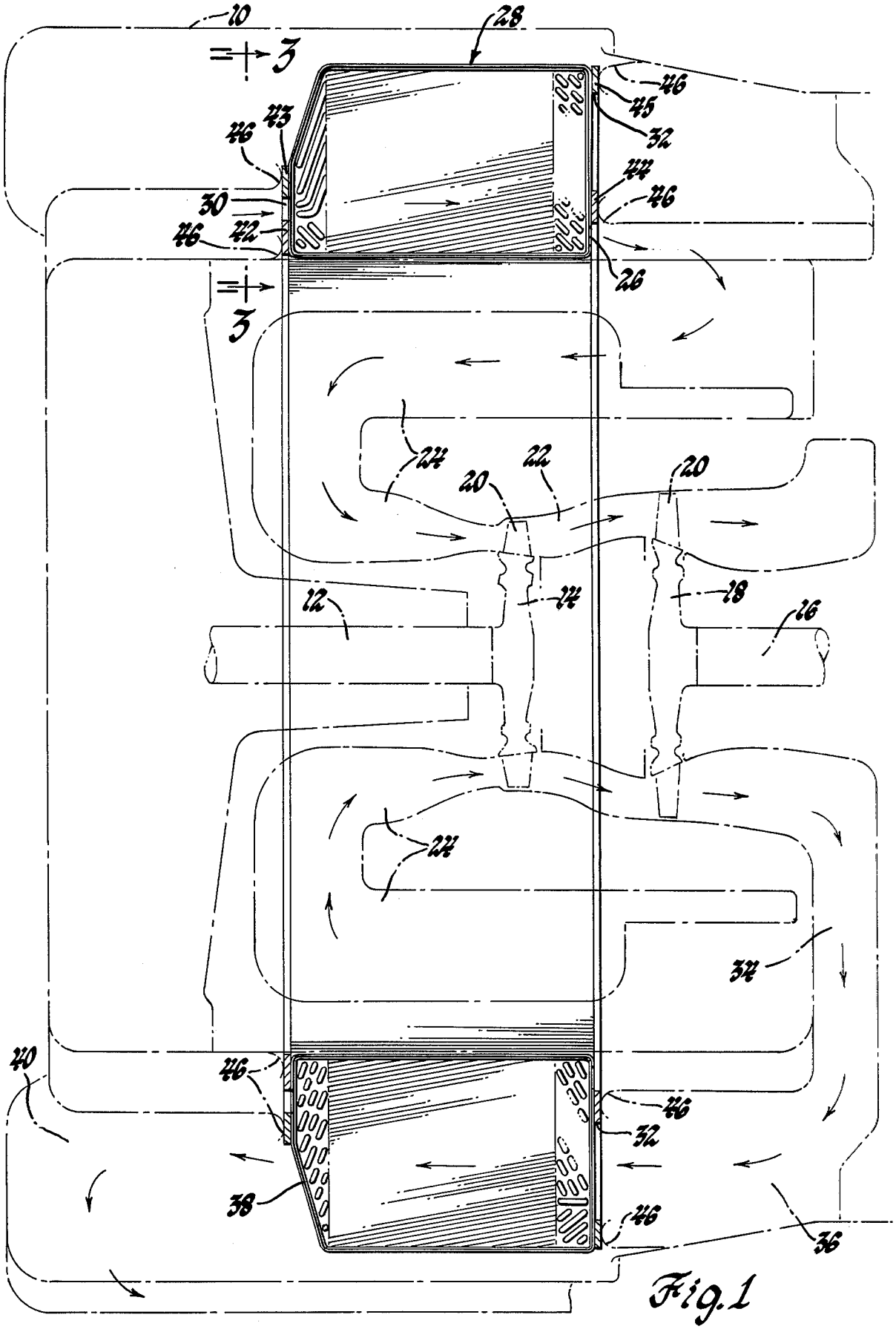
FIG. 1 is a phantom, fragmentary view of a gas turbine housing supporting the subject annular heat exchanger.
Figure 3:
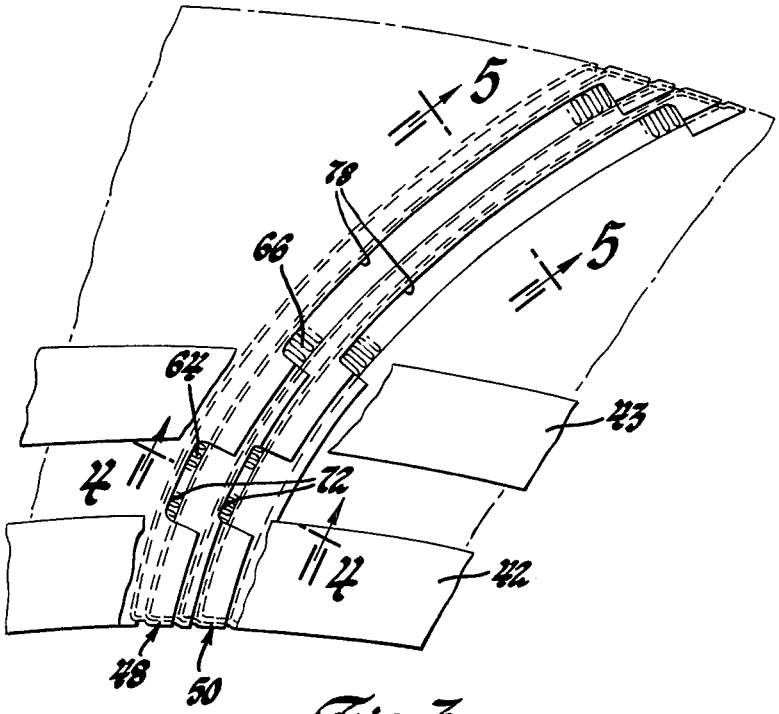
FIG. 3 is a fragmentary view of the heat exchanger looking in the direction of arrows 3—3 in FIG. 1.
Figure 5:
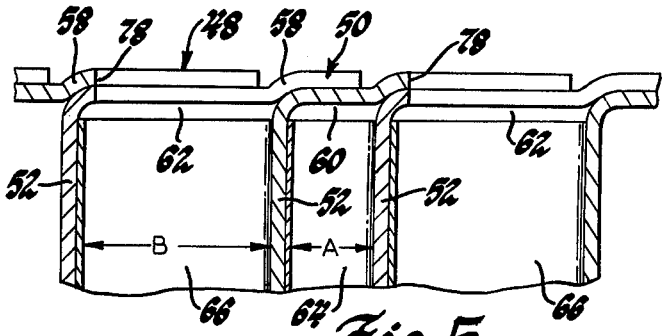
Figure 4:
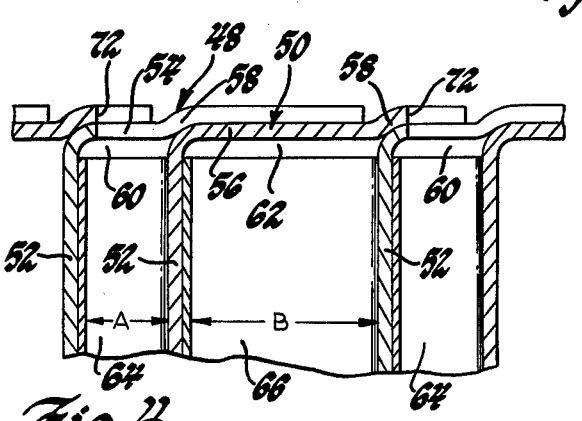
Figure 6:
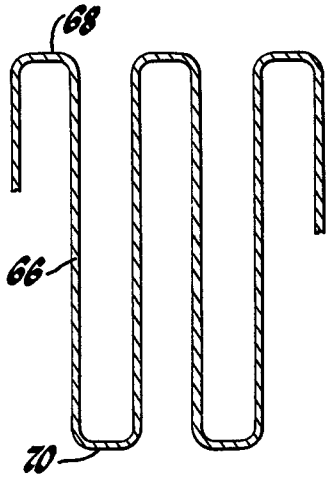
Figure 7:
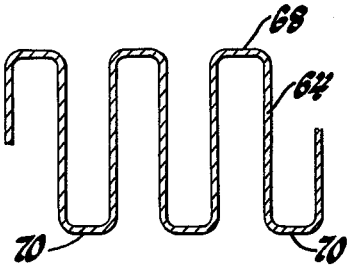
Figure 8:
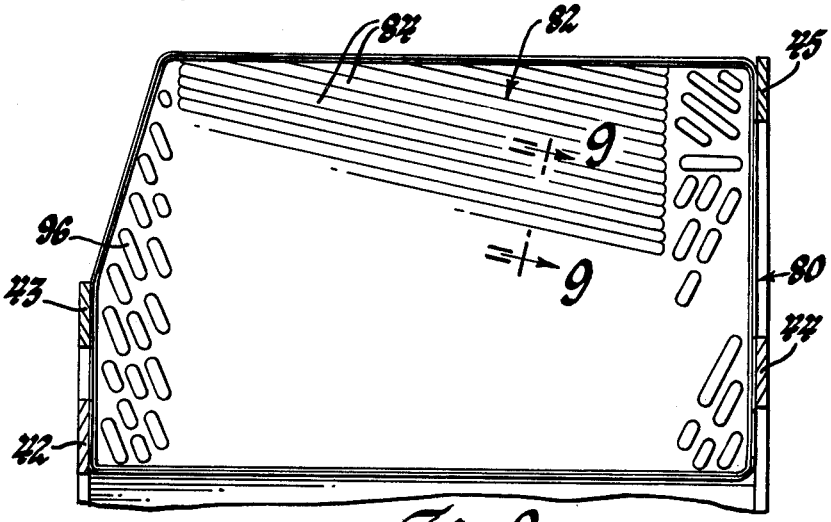
Figure 10:
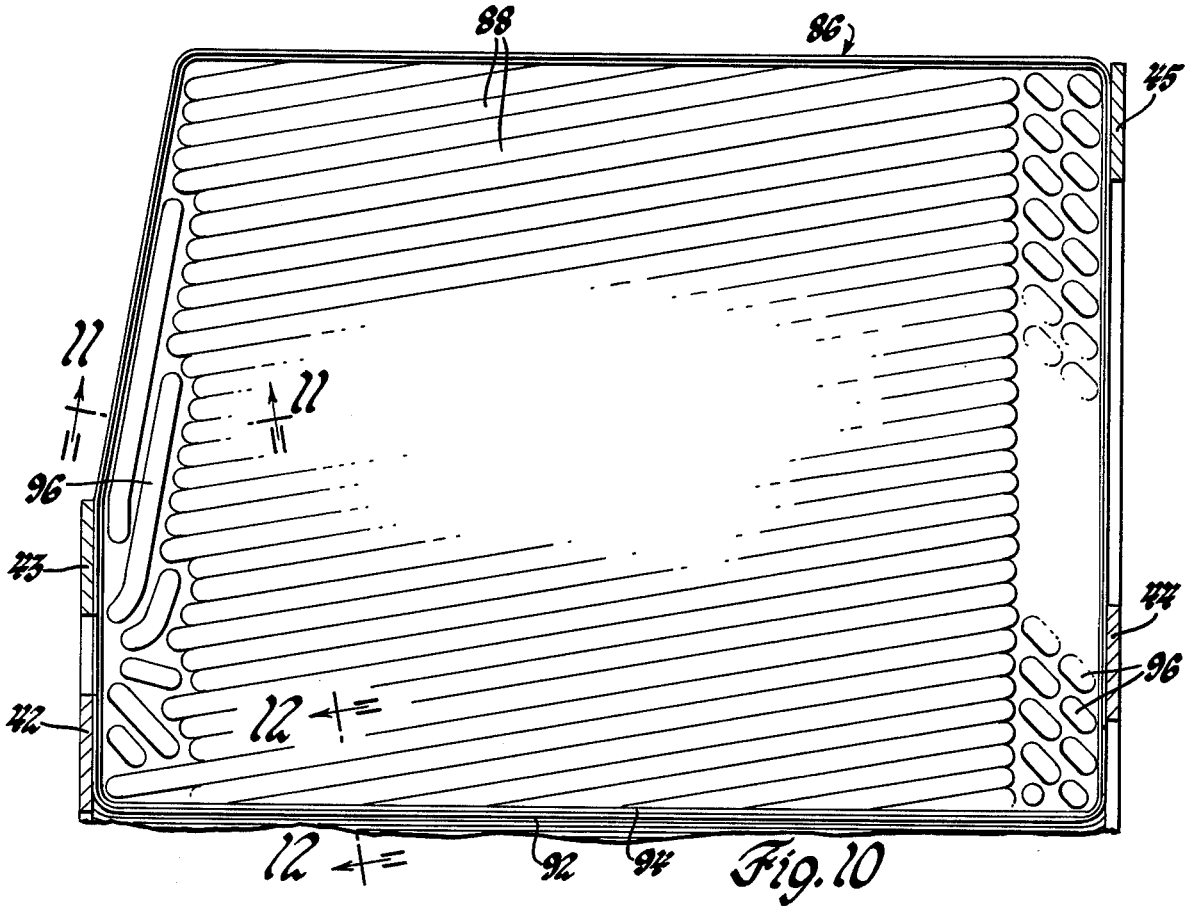
Figure 11:
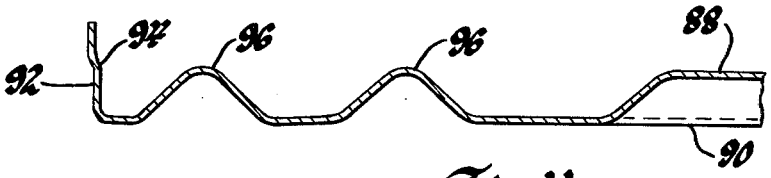
Figure 12:
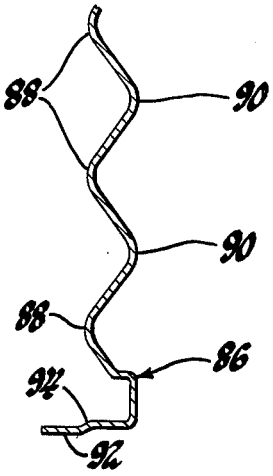
Figure 9:
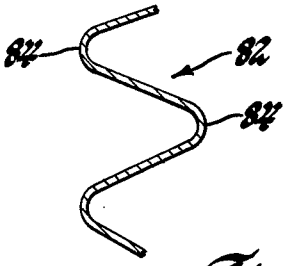
Figure 13:
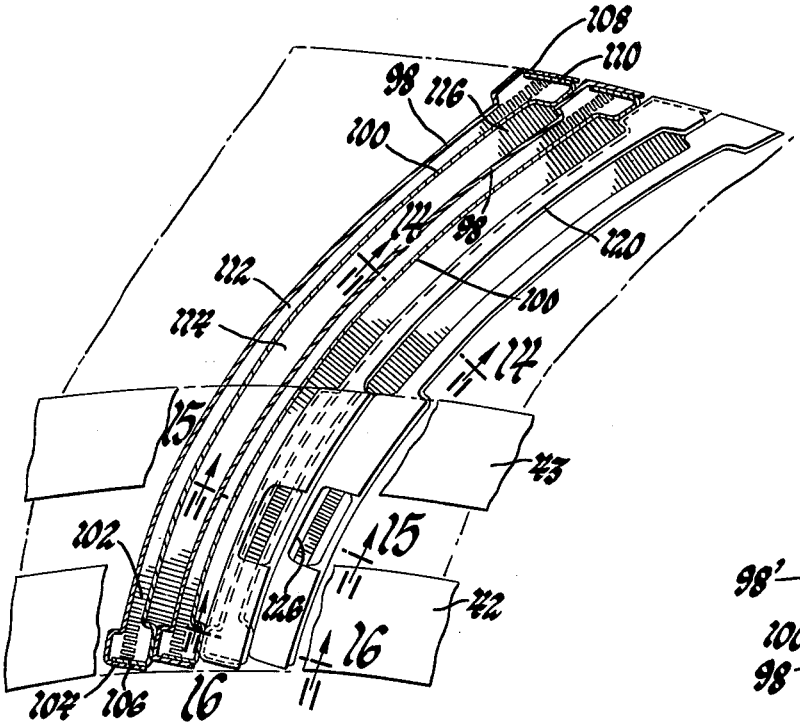
Figure 14:
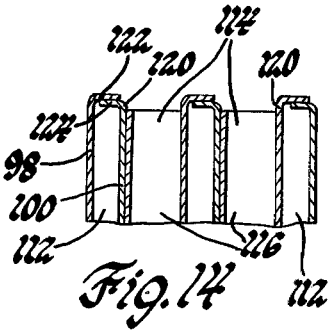
Figure 15:
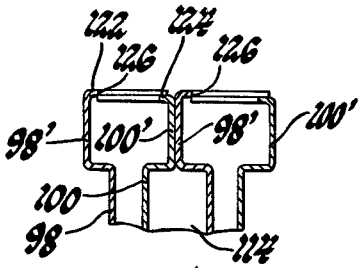
Figure 17:
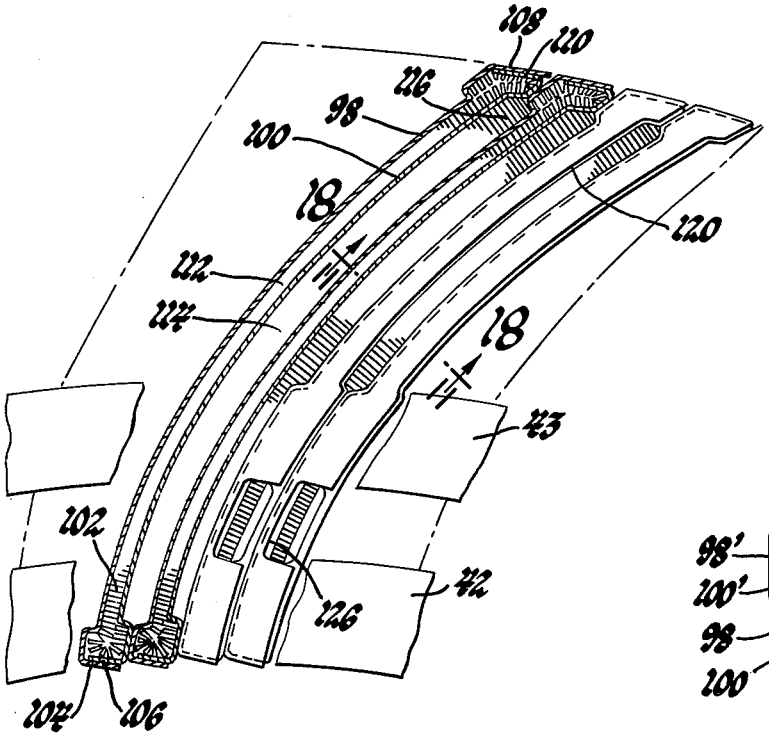
Figure 16:
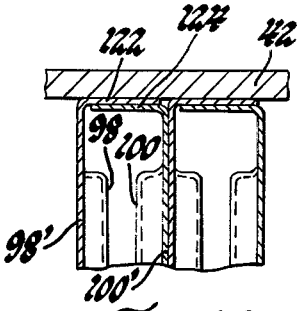
Figure 18:
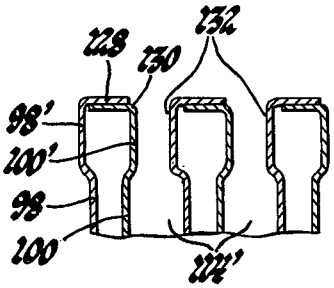
Figure 19:
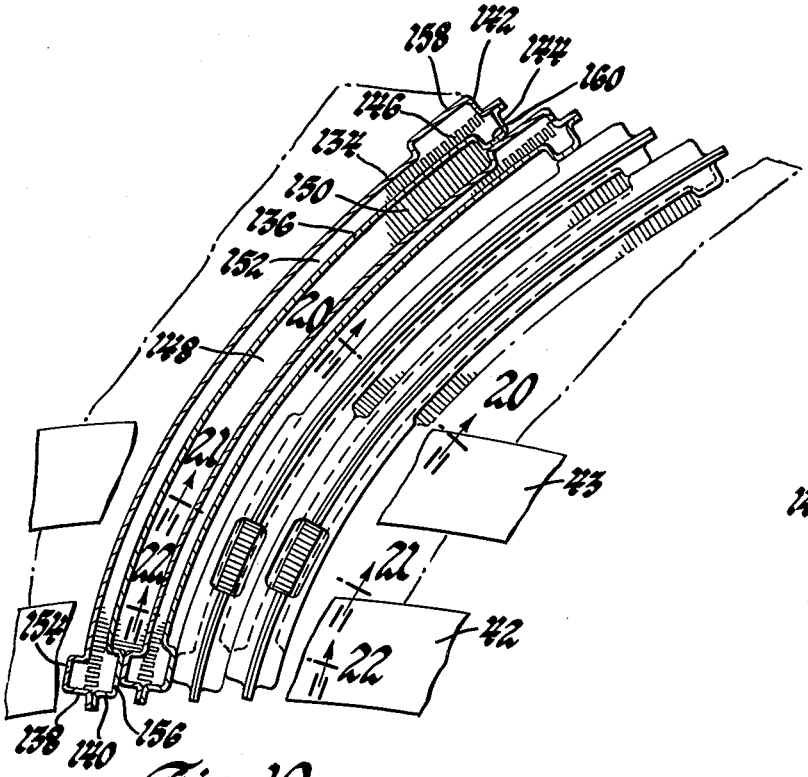
Figure 20:
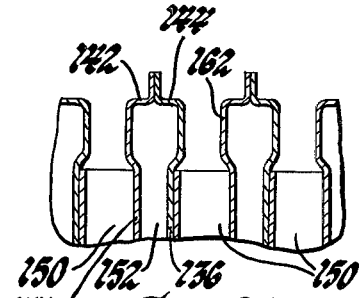
Figure 21:
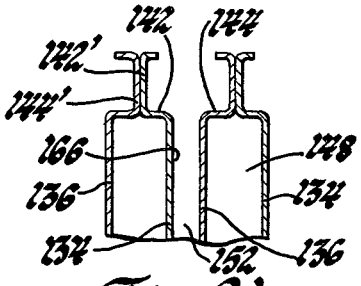
Figure 22:
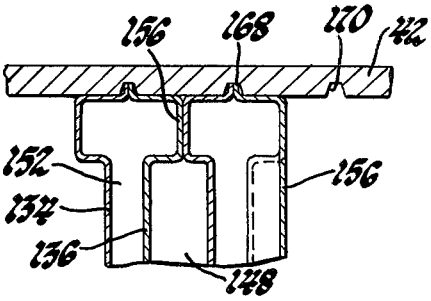
Figure 23:
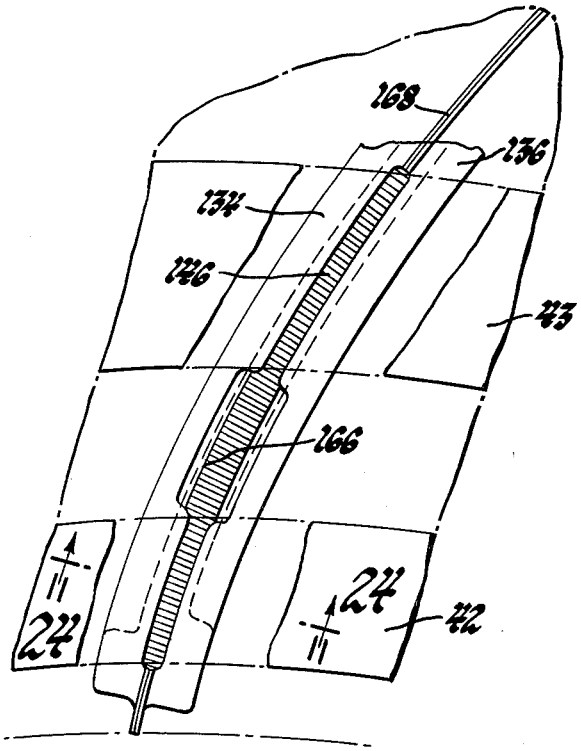
Figure 24:
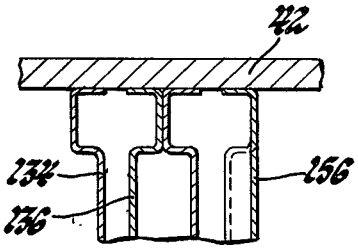

FIGS. 4 and 5 are section views of the separator plates of the heat exchanger taken along section lines 4—4 and 5—5 in FIG. 3;

FIGS. 6, 7 are sectioned views of the serpentine center used in the heat exchanger of FIGS. 1–5;

FIG. 8 is a view similar to FIG. 1 of another heat exchanger embodiment and particularly the exhaust gas plate;

FIG. 9 is a sectioned view taken along section lines 9—9 in FIG. 8 and looking in the direction of the arrows;

FIG. 10 is a view similar to FIG. 8 and showing an air plate;

FIGS. 11, 12 are enlarged sectioned views of the plates shown in FIG. 10 along section lines therein and looking in the direction of the arrows;

FIG. 13 is a view similar to FIG. 3 of still another embodiment of the subject invention;

FIGS. 14, 15, 16 are enlarged sectional views of the embodiment shown in FIG. 13 along the section lines therein and looking in the direction of the arrows;

FIG. 17 is a view similar to FIG. 3 of another embodiment of the present invention;

FIG. 18 is a sectioned view of the embodiment shown in FIG. 17 taken along section lines 18—18 and looking in the direction of the arrows;

FIG. 19 is a view similar to FIG. 3 of another embodiment of the present invention;

FIGS. 20, 21, 22 are sectioned views of the embodiment shown in FIG. 19 taken along the section lines therein and looking in the direction of the arrows;

FIG. 23 is a view similar to FIG. 3 of another embodiment of the present invention;

FIG. 24 is an enlarged sectioned view of the embodiment shown in FIG. 23 taken along section line 24—24 and looking in the direction of the arrows.

In FIG. 1 of the drawings, a portion of a turbine engine housing is shown by phantom lines. The housing 10 supports turbine components, such as a compressor shaft 12. One end of shaft 12 is adapted to be connected to a compressor rotor (not shown). The opposite end of shaft 12 is attached to a turbine rotor 14 for rotating the compressor. A second shaft 16 is connected to another turbine rotor 18 for producing a power output from the engine. Around the periphery of rotors 14, 18 are mounted a plurality of turbine blades 20 which extend across an annular passage 22 through which hot combustion gases flow from a combustion chamber 24.

The combustion chamber 24 receives compressed air from an air oultet 26 of the subject annularly configured heat exchanger 28. The air enters the heat exchanger 28 through an air inlet 30. The annularly configured heat exchanger 28 transfers heat from the exhaust gas into the intake air prior to admission into the combustion chamber 24. Specifically, the exhaust gases flow from the passage 22 through a radial passage 34 into an annular plenum 36 before entering an inlet 32 of the heat exchanger 28. After passing through the annularly configured heat exchanger, the exhaust gases pass through an outlet opening 38 and hence to a plenum chamber 40 and then to atmosphere.

A primary feature of the subject annularly configured heat exchanger 28 is structure to permit the simultaneous introduction and discharge of both air and exhaust gases through inlet and outlet openings formed in the opposite axial faces of the heat exchanger 28. The air inlet 30 and outlet 26 and the gas inlet 32 and outlet 38 are separated by annular continuous ring members 42, 43, 44 and 45. The rings are attached to the axial faces of the heat exchanger and are adapted to be engaged by face seals designated by numerals 46 in FIG. 1. These face seals 46 are made of a resilient metal to tolerate dimensional variations of the heat exchanger. This provides a satisfactory seal with the annular heat exchanger 28, even as it expands with increasing temperatures.

The first embodiment of the heat exchanger is shown in more detail in FIGS. 2 - 7. Basically, the heat exchanger is fabricated from a plurality of plates stacked one against the other to form fluid flow passages therebetween. Two different plates, air and exhaust gas plates 48, 50, are alternately stacked about a circular form into an annular configuration. The plates 48, 50 are similar except that the laterally extending edge portions of the air and exhaust plates are configured differently so as to space the central or middle body portions 52 a given dimensional distance A from an adjacent plate to form an air passage. Likewise, the edge of the exhaust gas plate spaces the gas plate a second greater dimensional distance B from an adjacent plate to form exhaust gas passages. This is shown in FIGS. 4 and 5. The reason for forming a decreased or thinner height passage for air than for exhaust gases is that the air is flowed through the annular heat exchanger under relatively high pressure due to the compressor stage of the turbine. In contrast, the exhaust gases are flowed through the heat exchanger under much less pressure and, therefore, a greater flow area produced by the increased height passage is desirable.

The air and gas plates 48, 50 have central body or midportions 52 which are encircled by peripheral edge portions 54, 56, respectively. The plates are spaced a predetermined distance from one another by engagement between shoulder portions 58 formed in the edges 54, 56 and the next adjacent plate. The shoulder portions 58 formed in the air plate are located closer to the midportion 52 whereas the shoulder portions 58 formed in the gas plates 50 are located further away from the midportion 52, thus varying the height passage for air and gas. Adjacent air passage 60 and the gas passage 62 are formed by alternately stacking air and gas plates 48, 50 into an annular configuration about an inner diameter circular form.

Figure 2:
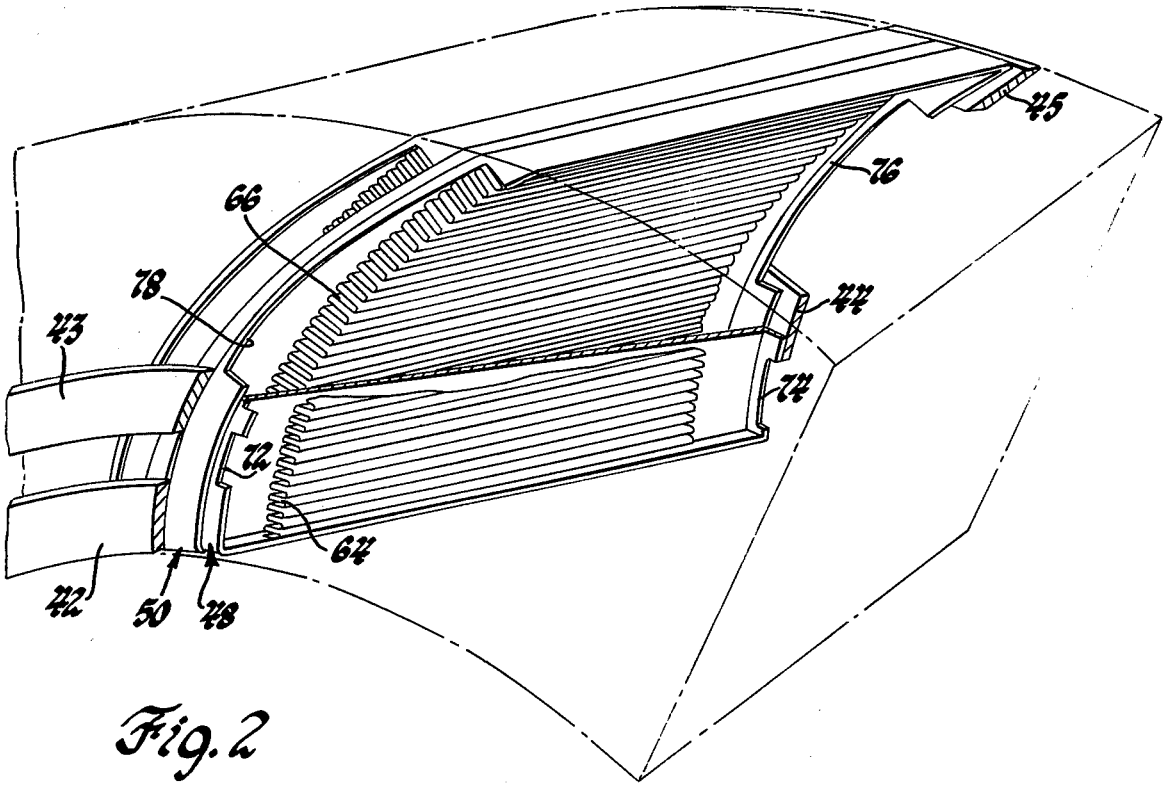
FIG. 2 is a perspective view of the annular heat exchanger broken away to reveal details of construction.

The midportions 52 of the plates 48, 50 are involutely curved, as is illustrated in FIGS. 2, 3, so that a radially inward portion extends more in parallelism with the radial line of the annular heat exchanger than does a radially outward portion. Resultantly, the effective thickness of the plates taken in the circumferential direction increases with increasing radial distance. The spacing between the midportions 52 of the plates 48, 50 remains constant over the radial dimension and the greater circumferential dimensions of the radial outward portions are taken up by the increased effective thickness. The involute curved shape of the plates also aids in maintaining the stamped shape of the plates so that handling and stacking is easier.

As shown in FIGS. 6, 7, corrugated or serpentine-shaped center or fin material 64, 66 is placed between the plates both in the air and gas passages 60, 62, respectively. The fin material 64, 66 presents a large surface area for contact with the hot exhaust gases and the cooler air and therefore the recuperator efficiency is enhanced. The opposite surfaces 68 and 70 contact the midportions 52 of the adjacent plates 48, 50. For even more effective heat transfer from exhaust gases to air through the plates, the centers 64, 66 should be brazed to one of the plates.

As previously discussed in connection with FIG. 1, air and gas inlet and outlet openings are formed in the axial faces of the annular heat exchanger. These openings are formed by cutting back the edge portions 54, 56 toward the central or midportion 52 of the plates. The openings in the air plates forming the inlet 72 and outlet 74 is shown in FIGS. 3, 4. The edge portions of the air plates 48 are cut back close to the plane of the midportion 52 and the edges of the gas plates 50 also recessed to form an aperture or opening for the flow of air to the passage 60. The openings 72, 74 are formed at a radially inwardly located point of the annularly configured heat exchanger as can be seen in FIG. 2. Specifically, the inlet and outlet are formed in a location between rings 42, 43 on one end and radially inward of ring 44 on the other end. Likewise, openings or apertures forming an inlet 76 and outlet 78 for gases are located in the axially facing edge portions of plates 48, 50. In the manner of forming the air inlet and outlet, the edges of the gas plate are cut back close to the midportion 52 of the plates and the edges of the air plates are recessed somewhat less. The gas openings are located at a radial outward location from the air inlet and outlet. Thus, the inlet 72 for air and the outlet 78 for gas are formed in one of the axially facing ends of the annularly configured heat exchanger, while the outlet 74 for air and the inlet 76 for gas are formed in the opposite axially facing end of the heat exchanger.

A second embodiment of the inventive annularly configured heat exchanger is shown in FIGS. 8 - 12. Instead of utilizing serpentine center material 64, 66 between the plates for support of the midportion of the plates, the midportion has a wave configuration impressed therein to strengthen the plate and to increase the heat transfer surface for greater contact with the air and exhaust gases. Specifically, in FIG. 8 an exhaust gas plate 80 is shown in plane view. Like plate 50 shown in FIG. 4, plate 80 has a peripheral edge portion extending laterally from a central midportion with shoulders formed thereon to space the plates and form air and exhaust gas passages therebetween. As shown in FIG. 9, the midportion 82 of the plate 80 has a wavy or undulating configuration including rolls or ridges 84 which are spaced one from another in the radial direction. The ridges 84 extend across the plates between the axially facing ends. The axis of the ridges 84 is inclined a predetermined amount from the axis of the annularly configured heat exchanger. In a preferred embodiment, this angular relationship is about 12°.

Likewise, the air plate 86 which is shown in FIG. 10 has an undulating or wavy form best shown in FIG. 12. The midportion of plate 86 has spaced ridge portions 88, 90 similar to the ridges 84 shown in FIG. 4. The angular orientation of the axis of the ridges 88, 90 is opposite that of the gas plate shown in FIG. 8. This opposite orientation of the ridges in the air and gas plates produces contact between the midpoints of the plates and thus rigidifies the structure so as not to permit the midportions to be distorted from their original configuration due to the pressurized air in alternate passages. The edges 92 of the air plate 86 have shoulder portions 94 adapted to engage the next adjacent plate and space the plates a predetermined distance one from another. Adjacent the inlet and outlet openings in the gas and air plates, ridges 96 are formed which help to distribute the fluid across the width of the passage.

Similar to the embodiment shown in FIGS. 1 – 7, the inlets and the outlets of the embodiment shown in FIGS. 8 – 12 are formed by recessed or cutback portions of the axially facing edges. Therefore, an air inlet and a gas outlet are formed in one axially facing end surface at radial inner and outer locations. Also, an air outlet and gas inlet are formed in the opposite axially facing end surface at radial inner and outer locations.

In FIGS. 13 – 16, a third embodiment of the subject heat exchanger is illustrated. It includes air passages formed between two adjacent plates 98 and 100. Plates 98 and 100 include an involutely curved midportion with a center fin strip 102 therebetween. The radially inner edge portions 104, 106 and the radially outer edge portions 108, 110 extend in overlapping relation to each other and may be joined together by brazing or soldering. The plates 98, 100 form an air pass or passage 112 therebetween. An adjacent gas passage 114 is formed between two modules comprising plates 98 and 100. The modules are spaced by coaction between the edge portions, as well as the positioning of a center fin strip 116 therebetween. Like in the previously described embodiments, air and gas inlets and air and gas outlets are formed in the axially facing edges by cutting back edge portions of the plates toward the midportion. The cut-back edge portions of the plates are positioned radially inward and outward as in the previous embodiment so that air inlets and outlets are conveniently separated by the continuous rings so that both fluids may be introduced and discharged from the same face of the annularly configured heat exchanger simultaneously.

In FIG. 14, details of the edge portions of the plates 98 and 100 are revealed. An aperture between alternate pairs of plates in FIG. 14, represents the exhaust gas outlet 120. The edges 122, 124 forming the axial face of the heat exchanger shown in FIGS. 13 extend laterally from the body portion of plates 98, 100 and in overlying relationship to each other. This encloses the air flow passage 112. An exhaust gas inlet and the opposite axial face is formed in a similar manner.

In FIG. 15, the axial edge portions 122, 124 are shown at the air inlet location. The air inlet 126 is formed by a cutback of the edge portion toward the main body of the plates 98, 100, so that an aperture is formed at a radially inward location, as shown in FIG. 13. Also apparent from FIGS. 14, 15 is the difference in the configuration of plates 98, 100 at a radially outward location and a radially inward location. At the radially outward location shown in FIG. 14, plates 98 and 100 are spaced a predetermined distance apart as defined by the edge portions 122 and 124. At the radially inner location shown in FIG. 15, the plates 98, 100 are spaced the same predetermined distance for most of the surface between the axial faces, but portions adjacent the edge, and specifically surfaces 98′ and 100′ are formed outward so that adjacent surfaces 98′ and 100′ engage one another to cause all incoming air to pass only through the inlet 126 and not between the joined pairs of plates. In FIG. 16, the configuration of the edges of plates 98, 100 near a radially inwardmost surface is illustrated. The overlapping edge portions 122, 124 are engaged by the continuous ring member 42. Unlike the configurations shown in FIG. 15 of the air inlet, the peripheral portions 98′, 100′ of the plates 98, 100 are formed outward from one another and spaced a greater distance than as shown in FIG. 14. Likewise, the peripheral edge portions of the plates 98, 100 at a radially outer location are spaced similarly, as shown in FIG. 16. This outward expansion of the peripheral edge portions of the plates provides a contacting surface for stack fabricating between adjacent pairs of plates or modules. These pairs of plates which are easily stacked one against another about an inner diameter form to produce an annular configuration heat exchanger very similar to the heat exchanger shown in FIG. 1.

The structure of the heat exchanger shown in FIG. 17 is similar to the heat exchanger shown in FIG. 13 and therefore common numbers are utilized to identify similar portions. Like the heat exchanger in FIG. 13, air passage modules are formed by joining plates 98 and 100 at their edge pairs 104, 106 and 108, 110. As shown in FIG. 18, the edge pairs 128, 130 are also engaged to space the plates and form the air passage module. However, a difference exists in the formation of the exhaust gas passage 114. In the embodiment shown in FIG. 17, as further shown in FIG. 18, the peripheral edges 98′ and 100′ of plates 98, 100 are formed outward to space the edges even further apart, thus forming a slightly narrower gas outlet 132 between modules. This outwardly formed edge portion creates an interior gas passage 114′ which may have a greater height than in the embodiment shown in FIG. 13. An advantage of this construction is the axial retention given the center or fin material 116 to maintain it in a desired position. Also, the exhaust passage 114′ may have a greater flow height to either decrease the resistance to gas flow of the low pressure fluid or to increase the mass of the center material 116 inserted in the gas passage. As can be seen in FIG. 17, the centers 114, 116 extend through the enlarged edge portion of the heat exchanger adjacent the innermost radial portion and the outermost radial portion.

In FIG. 19, a further embodiment of the invention is shown. This embodiment is similar to the embodiment shown in FIGS. 13, 17 in that adjacent plates have edge portions extending toward one another into engagement to form pairs of plates or air passage modules. Specifically, plates 134 and 136 are illustrated with radially inward and outward pairs of edges 138, 140 and 142, 144. The edges are turned laterally from the plate surface to form contacting edges for joining the plates 134, 136 together. An undulating or serpentine configured center or fin 146 is located between the plates 134, 136. Between adjacent modules or pairs of joined plates 134, 136 is formed an exhaust gas passage 148 in which is located an undulating or serpentine configured center 150. The midportion of the plates 134, 136 are spaced a predetermined distance apart to define the height of the air passage 152 therebetween. The peripheral portions of the plates 134, 136 are formed outward from the plane of the midportion, as shown by numerals 154, 156 at a radially inner location and by numerals 158, 160 at a radially outer location. These peripheral portions of adjacent modules engage one another when in stacked relation as the modules are placed next to one another about an inner diameter form, as previously suggested. Also, the outwardly drawn peripheral portions form the space between modules which defines the exhaust gas passage 148.

As shown in FIG. 20, exhaust gas outlets 162 are formed by the aperture between adjacent modules or pairs of plates 134, 136. As in FIG. 18, which was previously discussed, the peripheral portions of the plate along the axial faces are formed outward from the plane of the plates so as to provide an increased height exhaust gas passage 148 between the inlet and the outlet.

In FIG. 21, a view of the plates 134, 136 is provided at a radially inner location corresponding to the air inlet portion of the heat exchanger. In this vicinity, the edge portions 142, 144 are directed laterally opposite to the normal direction taken. This forms an air inlet aperture 166. The turned-back portions 142 and 144 of the plates 134, 136 in the vicinity of the inlet also have portions 142' and 144' which engage one another in the vicinity of the inlet. The turned-back edge portion 142' of one air center module extends toward a turned-back edge portion 144' of an adjacent air passage module to form the air inlet or outlet aperture.

FIG. 22 reveals the attachment of the continuous ring 42 to the adjacent pairs of plates or modules. The extending edge portion 168 is received by a series of grooves 170 formed on the underside of the ring 42. Thus, the ring 42 helps to secure the modules into the annular configuration of the heat exchanger and retain them in desired preset positions.

The embodiment of the annular heat exchanger shown in FIG. 23 is quite similar to the embodiment shown in FIG. 19 and, therefore, similar parts are numbered alike. However, rather than the formation of grooves in the continuous rings 42, 43 as shown in FIG. 22, the outwardly extending edge portions 168 are removed in the vicinity on either side of the aperture 166, as shown, for example, in FIG. 24. This saves some machining of the ring 42 and provides a more rigid ring assembly 42.

Although the embodiments illustrated are preferred, other embodiments may be proposed, all within the scope of the following claims, which define the invention.

What is claimed is as follows:

1. An annularly configured heat exchanger having opposite end surfaces through which two distinct fluids may simultaneously pass and flow parallel to one another in the axial direction, comprising: air and exhaust gas plates alternately stacked in side-by-side relation to one another forming air passages and exhaust gas passages alternately therebetween, each plate having a central portion spaced from the central portion of the next adjacent plate and a peripheral edge portion extending laterally from said central portion into engagement with an adjacent plate so as to space said plates, the peripheral edge portions in opposite axially facing sides being recessed toward the central portion of its associated plate to form openings to the spaces between the plates, the openings to said air passages and the openings to said gas passages being radially spaced and separated by a continuous annular surface on each end adapted to be contacted by seal means for separated introduction and discharge of said two fluids to and from the heat exchanger in the axial direction.

2. An annularly configured heat exchanger having opposite end surfaces through which two distinct fluids may simultaneously pass and flow parallel to one another in the axial direction, comprising: air and exhaust gas plates alternately stacked in side-by-side relation to one another forming air passages and exhaust gas passages alternately therebetween, each plate having a central portion spaced from the central portion of the next adjacent plate and a peripheral edge portion extending laterally from said central portion into engagement with an adjacent plate so as to space said plates, the peripheral edge portions in opposite axially facing sides being recessed toward the central portion of its associated plate to form openings to the spaces between the plates, the openings to said air passages and the openings to said gas passages being radially spaced and separated by a continuous annular surface on each end adapted to be contacted by seal means for separated introduction and discharge of said two fluids in the axial direction from concentric feed passages, the central portions of said plates having a wavy configuration including a plurality of offset parallel ridges adapted to engage the next adjacent plate, thereby strengthening the heat exchanger and preventing outward movement of the plate's central portions when exposed to pressurized air and also increasing the surface area of the plates separating the two fluids.

3. The heat exchanger as set forth in claim 2 with the angular orientation of the wavy configuration of the air plates being different than the orientation of the gas plates so that air and exhaust gases are smoothly routed between their radially inward and outward located inlet and outlet locations and, further, so that the parallel ridge portions of one plate contact the next adjacent plate at multiple locations due to the resultant different orientation of the ridge axes.

4. An annularly configured heat exchanger having opposite end surfaces through which two distinct fluids may simultaneously pass and flow parallel to one another in the axial direction, comprising: modules formed by joined pairs of plates extending in side-by-side relation to one another and defining a first fluid flow passage therebetween; said modules being stacked in side-by-side relationship into an annular configuration; the module plates each having a central portion and a peripheral edge portion extending laterally therefrom; the edge portions in each module extending in overlapping relation to enclose said first fluid flow passage; said central portion of the plates having a first surface offset with respect to a second surface to form second fluid flow passages between said first surfaces of the stacked modules; said second surfaces of one module engaging the second surfaces of an adjacent module to enclose said second fluid flow passage; a part of the peripheral edge portions along the axially facing sides of the plates being recessed toward the central portion of its associated plate to form openings to the first fluid flow passage; said first surfaces of said plates extending to said peripheral edge portion along a part of the axially facing edge of the plates to form openings to the second fluid flow passages between the modules; said openings to said first fluid flow passages and to said second fluid flow passages being radially spaced and separated by a continuous axial surface which is adapted to be engaged by seal means of an associated housing for separated introduction and discharge of said two fluids in the axial direction.

* * * * *

UNITED STATES PATENT AND TRADEMARK OFFICE

CERTIFICATE OF CORRECTION

PATENT NO. : 4,098,330

DATED : July 4, 1978

INVENTOR(S) : Robert J. Flower and Marshall E. Seddon

It is certified that error appears in the above-identified patent and that said Letters Patent are hereby corrected as shown below:

In the Abstract, line 15, "and" should be -- an --; same line, "an" should be -- and --.

Column 1, line 18, "or" should be -- nor --.

Column 1, line 19, "subjected" should be -- subject --.

Column 3, line 8, "oultet" should be -- outlet --.

Column 5, line 65, "and" should be -- at --.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*